US012529275B1

(12) United States Patent
Al-Saleh et al.

(10) Patent No.: US 12,529,275 B1
(45) Date of Patent: Jan. 20, 2026

(54) CEMENT DUMP BAILER WITH HOLLOW BRIDGE PLUG

(71) Applicant: SAUDI ARABIAN OIL COMPANY, Dhahran (SA)

(72) Inventors: Abdullah S. Al-Saleh, Dhahran (SA); Mortada A. Alkadem, Dhahran (SA); Abdullah A. Alomair, Dhahran (SA); Abdulkareem K. Alnafea, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/792,370

(22) Filed: Aug. 1, 2024

(51) Int. Cl.
*E21B 27/02* (2006.01)
*E21B 27/00* (2006.01)
*E21B 33/134* (2006.01)

(52) U.S. Cl.
CPC ..... *E21B 27/02* (2013.01); *E21B 33/134* (2013.01); *E21B 27/00* (2013.01)

(58) Field of Classification Search
CPC ..... E21B 27/02; E21B 33/134; E21B 27/00
See application file for complete search history.

(56) References Cited

U.S. PATENT DOCUMENTS 1,858,501 A * 5/1932 Hinderliter ..... E21B 27/02 166/166
2,618,345 A * 11/1952 Tucker ..... E21B 33/134 166/123
2,653,666 A * 9/1953 Baker ..... E21B 27/02 166/63
2,695,065 A * 11/1954 Baker ..... E21B 23/065 166/187
2,707,998 A * 5/1955 Baker ..... E21B 27/02 166/162
3,154,149 A * 10/1964 Peters ..... E21B 27/02 294/68.25
6,341,654 B1 * 1/2002 Wilson ..... E21B 33/1275 166/387
10,337,270 B2 7/2019 Carisella et al.
2010/0122814 A1 * 5/2010 Picou ..... E21B 43/045 166/278
2019/0169954 A1 * 6/2019 Cabot ..... E21B 23/08
2019/0169955 A1 * 6/2019 Knight ..... E21B 37/045
2021/0372216 A1 * 12/2021 Lende ..... E21B 33/13
2022/0106853 A1 * 4/2022 Hallundbæk ..... E21B 27/02
2022/0154547 A1 * 5/2022 Fairweather ..... E21B 37/00

* cited by examiner

*Primary Examiner* — Neel Girish Patel
(74) *Attorney, Agent, or Firm* — Vorys, Sater, Seymour and Pease LLP

(57) ABSTRACT

A system for performing water shut-off and logging operations in wellbores includes a bridge plug assembly including a cylindrical body, one or more expandable elements mounted to the cylindrical body and operable to generate a pressure seal within the wellbore, a hollow pipe extending vertically from the cylindrical body, and a flared opening at an upper end of the hollow pipe. The system further includes a cement bailer for cementing the bridge plug in place within the wellbore, the cement bailer including a conical tip at a lower end of the cement bailer sized to generate a seal within the flared opening of the hollow pipe of the bridge plug assembly, and one or more lateral apertures defined in an outer surface of the cement bailer and operable to expel cement from an interior of the cement bailer.

15 Claims, 5 Drawing Sheets

CEMENT DUMP BAILER WITH HOLLOW BRIDGE PLUG

FIELD OF THE DISCLOSURE

The present disclosure relates generally to shutting off water penetration into a wellbore and, more particularly, to systems and methods for preserving access to zones in a wellbore that are isolated in water shut-off operations.

BACKGROUND OF THE DISCLOSURE

Oil and gas industry well operators commonly employ bridge plugs for the control of fluid flows within a wellbore. More specifically, bridge plugs may be utilized to isolate a specific zone or section of the wellbore, and thereby seal off water-producing zones. These water shut-off operations can increase the lifetime of a well through the strategic sealing of water-producing lower (downhole) zones while continuing production within higher (uphole) zones. This targeted isolation of water-producing zones within the wellbore can further reduce operational costs associated with water management downhole. As such, the use of bridge plugs for water shut-off applications can increase efficiency and cost-effectiveness of a hydrocarbon wellbore.

Common practices for the deployment of bridge plugs include advancing the bridge plug to a desired location within the wellbore and then extending an expandable element of the bridge plug to generate a seal with a wall of the wellbore. Following the setting of the bridge plug, a cement bailer may be run downhole and utilized to deposit cement above the bridge plug to thus fortify the seal and fully isolate the water-producing zone. While the cement can ensure a permanent placement of the bridge plug and cessation of water production, the cement may also permanently prevent access to a portion of an oil-producing zone above the bridge plug. This arrangement can have several drawbacks. For example, in some cases, where hydrocarbons remain within the permanently cemented area, production logging tools may be unable to access these isolated zones. Thus, sidetracking or further drilling operations can be necessitated to access these remaining resources.

Accordingly, systems and methods for performing water shut-off operations in a wellbore while enabling access to isolated zones for future logging and production operations are desirable.

SUMMARY OF THE DISCLOSURE

Various details of the present disclosure are hereinafter summarized to provide a basic understanding. This summary is not an exhaustive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a system for performing water shut-off and logging operations in wellbores includes a bridge plug assembly for isolating a lower portion of a wellbore from an upper portion of the wellbore. The bridge plug assembly includes a cylindrical body, one or more expandable elements mounted to the cylindrical body and operable to generate a pressure seal within the wellbore, a hollow pipe extending vertically from the cylindrical body, and a flared opening at an upper end of the hollow pipe. The system further includes a cement bailer for cementing the bridge plug in place within the wellbore, the cement bailer including a conical tip at a lower end of the cement bailer sized to generate a seal within the flared opening of the hollow pipe of the bridge plug assembly, and one or more lateral apertures defined in an outer surface of the cement bailer and operable to expel cement from an interior of the cement bailer.

In another embodiment, a method of performing water shut-off and logging operations in wellbores includes advancing a bridge plug assembly in an un-actuated state within a wellbore to a water shut-off location, the bridge plug assembly including a hollow pipe extending from a cylindrical body and a flared opening at an upper end of the hollow pipe, actuating one or more expandable elements of the bridge plug assembly to generate a seal within the wellbore, and advancing a cement bailer within the wellbore to a vicinity of the bridge plug assembly, the cement bailer including a conical tip at a lower end. The method further includes inserting the conical tip of the cement bailer into the flared opening of the hollow pipe of the bridge plug assembly to generate a seal within the flared opening, expelling cement from the cement bailer around an external surface of the hollow pipe of the bridge plug assembly, and retracting the cement bailer out of the wellbore after setting of the cement around the bridge plug assembly.

In a further embodiment, a cement bailer includes an elongate body defining an outer circumferential surface, one or more lateral apertures defined through the outer circumferential surface of the elongate body, a piston mounted within a lower end of the elongate body and operable to push cement towards the lateral apertures, and a conical tip at the lower end of the elongate body and extending vertically downwards.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
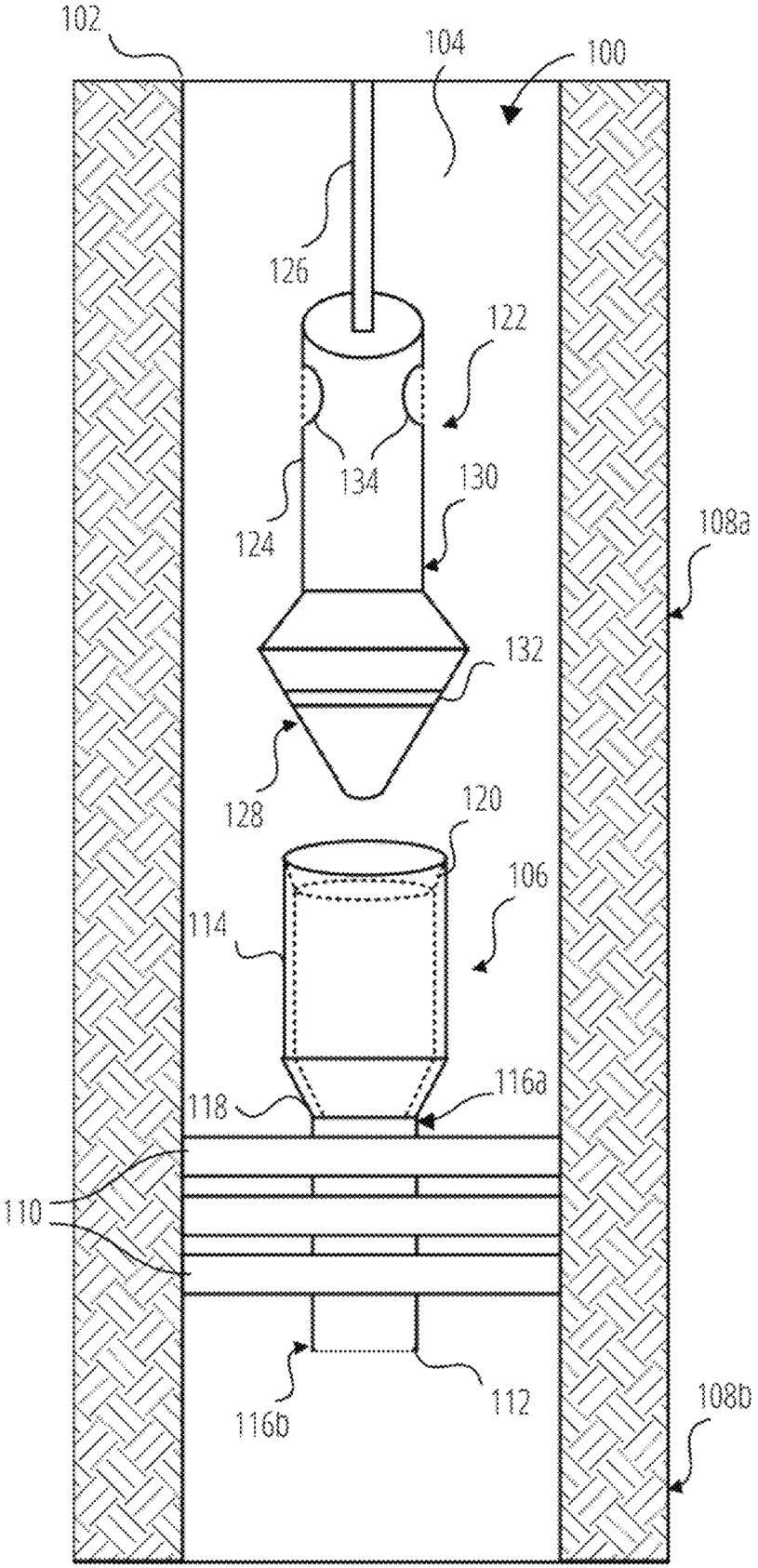
FIG. 1 is a schematic view of a system including a bridge plug assembly and a cement bailer for performing water shut-off operations in a wellbore, according to one or more embodiments consistent with the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure relate generally to water shut-off operations in a wellbore and, more particularly, to systems and methods for depositing cement above a hollow bridge plug assembly in the wellbore to isolate a water producing zone below the bridge plug. The bridge plug assembly employed in systems and methods disclosed herein can include a hollow pipe extending therefrom to enable receiving a portion of a cement bailer and generating a seal therewith during cement deposition. The bridge plug assembly may accordingly include a flared opening to aid in guiding of the fluids and tools into the hollow pipe, and further provides a mating surface for the cement bailer from which the cement may be deposited. The cement bailer in the disclosed embodiments may include a conical lower tip that is insertable within the flared opening to prevent cement from entering the hollow pipe. The cement bailer may provide lateral apertures through which cement may flow about an exterior of the cement bailer and around the hollow pipe of the bridge plug assembly. As such, the disclosed systems and embodiments may provide a flowpath through a cemented area and up to a bridge plug assembly, as well as providing features that ensure the bridge plug may be cemented without clogging an interior of the hollow pipe. The use of the disclosed systems and methods may thus enable saturation and production logging a full extent of a vertical or deviated wellbore up to a bridge plug following a water shut-off operation.

FIG. 1 is a schematic view of an example system 100 for performing water shut-off operations in a wellbore, according to one or more embodiments consistent with the present disclosure. The system 100 may be deployed within a wellbore 102 utilized in hydrocarbon extraction operations, and may be inserted within a wellbore flowpath 104 defined within the wellbore 102. In some embodiments, water production in one or more zones may dilute or contaminate the hydrocarbons extracted through the wellbore flowpath 104. As such, the system 100 may provide a bridge plug assembly 106 deployable within the wellbore 102 to isolate an upper portion 108*a* of the wellbore 102 from a lower portion 108*b* of the wellbore 102, which may include water producing zones. In the illustrated embodiment, the bridge plug assembly 106 prevents water production from the lower portion 108*b*, while allowing for hydrocarbon extraction operations to continue through the upper portion 108*a*.

The bridge plug assembly 106 may include one or more expandable elements 110 operable to extend from a cylindrical body 112 of the bridge plug assembly 106 to generate a seal within the wellbore 102. The one or more expandable elements 110 can be actuated hydraulically, pneumatically, or electrically to expand against an inner circumferential surface of the wellbore 102. The seal generated within the wellbore 102 via the expandable elements 110 may prevent the flow of fluids across the bridge plug assembly 106, and may accordingly shut-off water production from the lower portion 108*b* of the wellbore 102.

In the disclosed embodiments, the bridge plug assembly 106 may include a hollow pipe 114 extending (e.g., vertically or uphole) from the cylindrical body 112. The hollow pipe 114 may provide a wider-diameter flowpath into the cylindrical body 112. In some embodiments, the hollow pipe 114 may extend about ten feet vertically (uphole) from the cylindrical body 112 at an upper end 116*a* of the bridge plug assembly 106. The bridge plug assembly 106 may further include a crossover connection 118 that provides a transition between the cylindrical body 112 and the larger hollow pipe 114 and mates the upper end 116*a* of the bridge plug assembly 106 with a lower end 116*b*.

In some embodiments, the bridge plug assembly 106 may further include a flared opening 120 inside the hollow pipe 114. The flared opening 120 may provide a wider (larger diameter) aperture for introducing fluids or tooling into the bridge plug assembly 106. For example, in some embodiments, the flared opening 120 may further facilitate mating between the bridge plug assembly 106 and a cement bailer 122 of the system 100.

The cement bailer 122, as shown in the illustrated embodiment, may comprise an elongate body 124 extendable within the wellbore 102 and towards the bridge plug assembly 106. The elongate body 124 may be coupled to a conveyance 126 such as a wireline, slickline, coiled tubing, drill pipe, etc. for transporting the cement bailer 122 toward the bridge plug 106. The cement bailer 122 may include a conical tip 128 at a lower end 130 of the elongate body 124, such that the conical tip 128 may protrude vertically downwards (e.g., downhole) from the elongate body 124 and towards the set bridge plug assembly 106. In some embodiments, the conical tip 128 may be sized to be at least partially received within the flared opening 120 of the hollow pipe 114 of the bridge plug assembly 106. In these embodiments, the conical tip 128 may advance within the flared opening 120 and hollow pipe 114 until a conical surface of the conical tip 128 abuts (engages) the flared opening 120. The conical tip 128 and flared opening 120 may generate an interference seal at an interface thereof, such that the hollow pipe 114 and interior of the flared opening 120 are isolated from any fluid flows in the wellbore flowpath 104.

In some embodiments, the conical tip 128 may include a magnet 132 inlaid therein such that the magnet 132 does not protrude from the outer surface of the conical tip 128. The magnet 132 may circumscribe the outer conical surface and may have a diameter approximately equal to a diameter of the flared opening 120. The magnet 132 may aid in locating the conical tip 128 within the flared opening 120, and to further maintain a seal between the conical tip 128 and the flared opening 120. More specifically, when the conical tip 128 is inserted at a desired depth within the hollow pipe 114, the magnet 132 may magnetically attract and directly abut an inner circumferential surface of the flared opening 120.

The cement bailer 122 may further include one or more lateral apertures 134 defined through an outer surface of the elongate body 124. As described in greater detail below, cement (e.g., cement 202 of FIG. 2) within the elongate body 124 may be induced to flow through the lateral apertures 134 and around an exterior of the conical tip 128. The interference seal between the conical tip 128 and the flared opening 120 may prevent cement from flowing into the hollow pipe 114, while enabling the cement to flow around the conical tip 128 and onto the extended (set) expandable elements 110.

Figure 2:
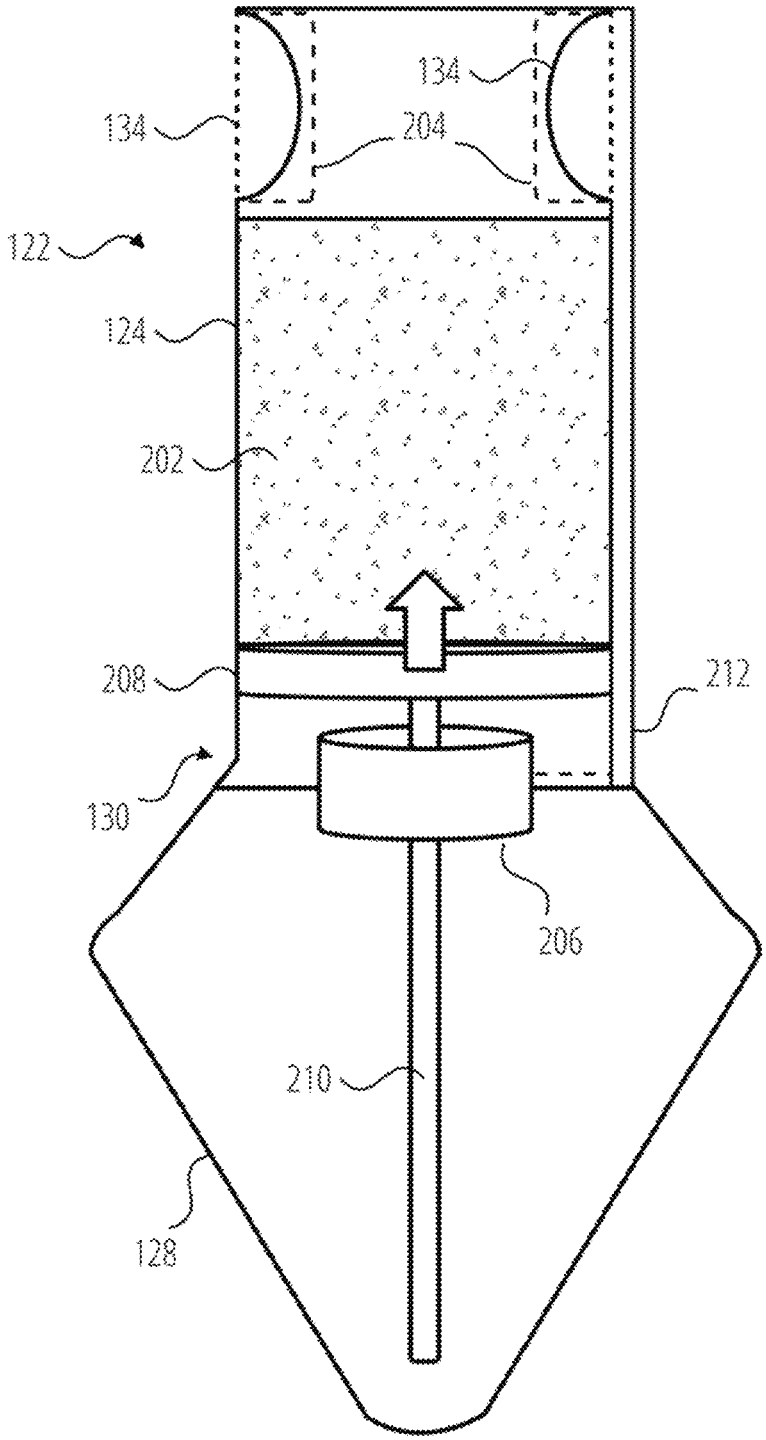
FIG. 2 is a schematic view of the cement bailer of the system, according to one or more embodiments consistent with the present disclosure.

FIG. 2 is a schematic section view of the cement bailer 122 of the system 100, according to one or more embodiments consistent with the present disclosure. As shown, the elongate body 124 of the cement bailer 122 may be at least partially filled with cement 202. The cement 202 may be stored within, or be provided to, the cement bailer 122 for expulsion through the lateral apertures 134 defined through the outer surface of the elongate body 124. In some embodiments, the cement bailer 122 may include closure members 204 (shown in dashed lined) operably coupled with the lateral apertures 134. The closure members 204 may comprise a sliding sleeve or similar mechanism to selectively control (i.e., prevent or allow) the flow of the cement 202 through the lateral apertures 134 as desired.

The closure members 204 may remain in a closed position where the lateral apertures 134 are occluded until the conical tip 128 is properly mated with the bridge plug assembly 106 of FIG. 1. Once the conical tip 128 locates and is properly mated with the bridge plug assembly 106, the closure members 204 may be actuated and otherwise moved to an open position where the lateral apertures 134 become exposed to enable fluid communication between the interior of the cement bailer 122 and the wellbore flowpath 104 of FIG. 1.

In some embodiments, the cement bailer 122 may include a piston 206 movably mounted within the lower end 130 of the cement bailer 122. The piston 206 may be positioned vertically upward, such that actuation of the piston 206 may translate a piston head 208 vertically upwards within the cement bailer 122. In the illustrated embodiment, the cement 202 is shown resting above the piston head 208 such that vertical translation (movement) of the piston head 208 may advance the cement 202 towards the lateral apertures 134. The piston head 208 may be mated to a piston rod 210 to enable travel of the piston head 208 at a desired distance to expel the entirety of the cement 202 (or any predetermined amount of cement 202) through the lateral apertures 134. In some embodiments, the piston rod 210 may extend vertically downwards into the conical tip 128 when in an unactuated state (prior to being actuated to expel the cement 202 through the lateral apertures 134).

In at least one embodiment of the present disclosure, the cement bailer 122 may include a cable 212 electrically coupled to the piston 206. The cable 212 may also be electrically coupled to the conveyance 126, such as a wireline, used to convey the cement bailer into position as described above. In these embodiments, the cable 212 may provide an actuation signal and power to enable extension of the piston head 208 and piston rod 210 within the cement bailer 122.

Figure 3:
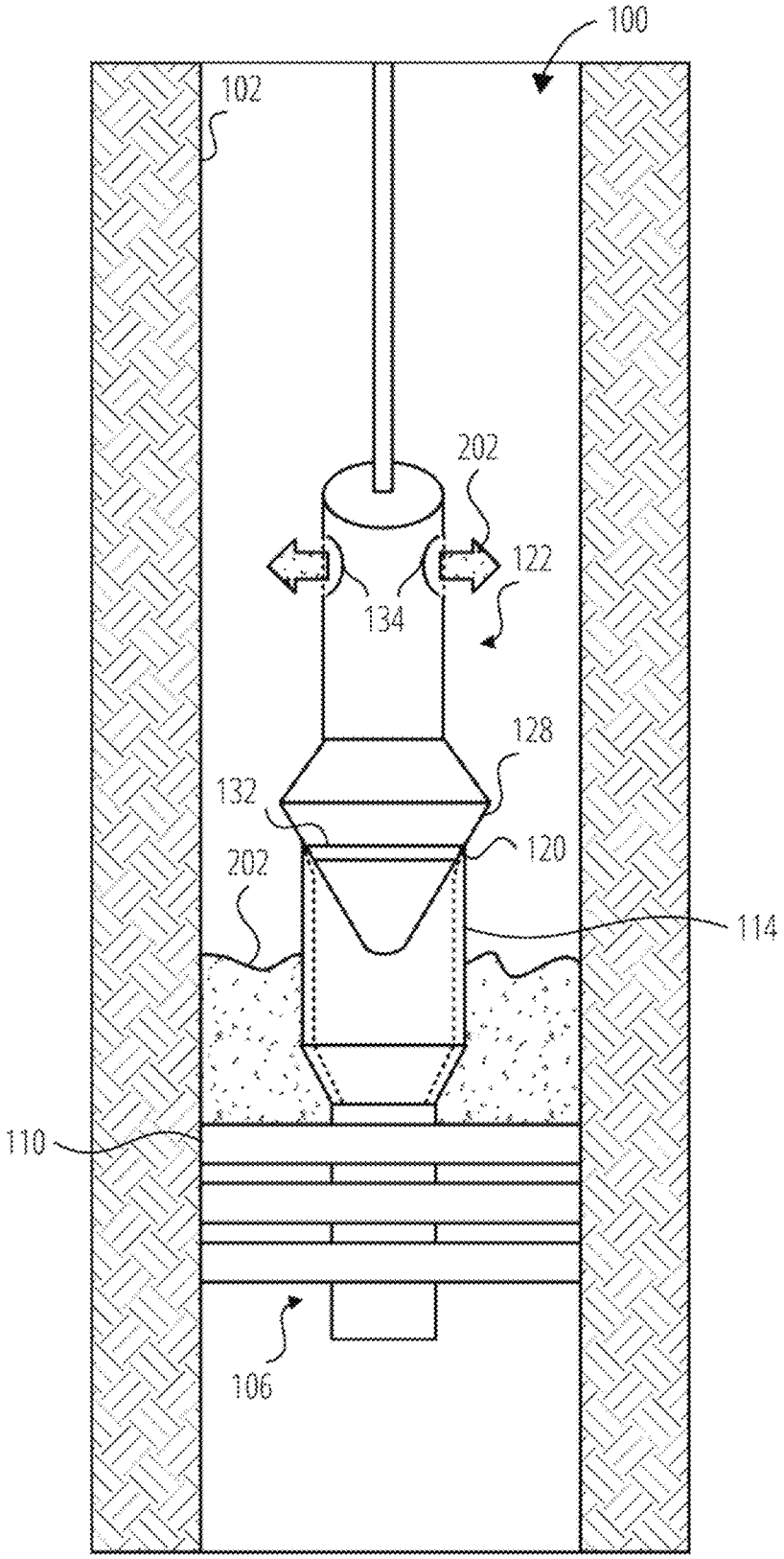
FIG. 3 is a schematic view of the system during a cementing operation wherein cement is deposited above the bridge plug, according to one or more embodiments consistent with the present disclosure.

FIG. 3 is a schematic view of the system 100 during a cementing operation, according to one or more embodiments consistent with the present disclosure. As discussed above, once the conical outer surface of the conical tip 128 is mated against the flared opening 120 of the hollow pipe 114, the cement 202 may be expelled through the lateral apertures 134 of the cement bailer 122. The magnet 132 may be positioned against (engaged with) an internal circumferential surface of the hollow pipe 114 and the flared opening 120 to provide additional latching (magnetic attraction) and sealing against the flowing cement 202. As the cement 202 flows around an exterior of the conical tip 128 and the outer surface of the hollow pipe 114, the cement 202 may settle atop a top-most expandable element 110. The cement 202 may continue to flow about the bridge plug assembly 106 and hollow pipe 114 until reaching a desired cementing level below the flared opening 120. In some embodiments, the hollow pipe 114 may extend about ten feet vertically from the cylindrical body 112 and the cement 202 may surround about nine feet or less of the hollow pipe 114. As such, the bridge plug assembly 106 may be cemented in place while leaving the flared opening 120 and plug flowpath 115 of the hollow pipe 114 open to fluids and tooling.

In conventional systems, the flow of cement 202 may cover a set bridge plug and permanently seal off the wellbore 102. In the disclosed system 100, however, the sealed interface between the conical tip 128 and the flared opening 120 may provide an isolated portion of the bridge plug assembly 106 that is not blocked (covered) with cement 202. As such, the cement bailer 122 may be retracted out of hole following discharge and solidification of the cement 202. Upon decoupling (separating) the conical tip 128 from the flared opening 120 of the bridge plug 106, the flared opening 120 may be exposed to the wellbore flowpath 104 while the hollow pipe 114 the bridge plug assembly 106 is cemented in place within the wellbore 102.

Figure 4:
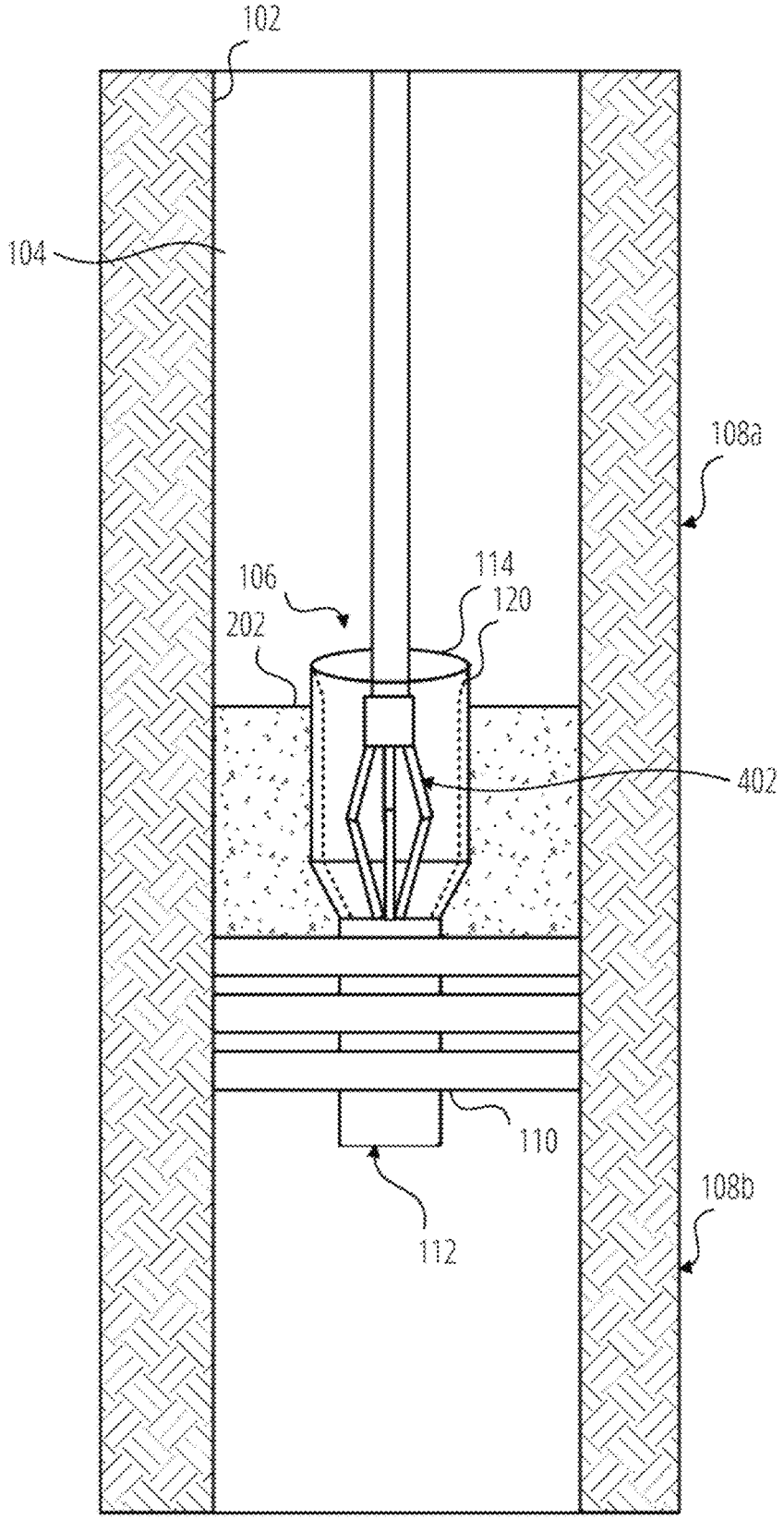
FIG. 4 is a schematic view of the bridge plug and the cement in the wellbore with a logging tool inserted therethrough, according to one or more embodiments consistent with the present disclosure.

FIG. 4 is a schematic view of a cemented bridge plug assembly 106 with a logging tool 402 inserted therethrough, according to one or more embodiments consistent with the present disclosure. Following the decoupling of the cement bailer 122 (FIGS. 1-3) from the bridge plug assembly 106, the hollow pipe 114 may be accessible within the wellbore flowpath 104 via the flared opening 120. As such, while the bridge plug assembly 106 is cemented in place within the wellbore 102, the hollow pipe 114 may be accessed through the cemented portion of the wellbore 102 and up to the cylindrical body 112.

As shown in FIG. 4, the logging tool 402 may be run within the wellbore flowpath 104 and may locate and be received within into the hollow pipe 114 of the bridge plug assembly 106. The logging tool 402 may be used in production and saturation logging operations within the wellbore 102. In conventional systems, the cementing of the bridge plug assembly 106 may preclude the use of a logging tool 402 in the cemented portion of the wellbore 102. In the illustrated embodiment, however, the exposed flared opening 120 and the hollow pipe 114 may provide a conduit through which the logging tool 402 may extend. As such, the system 100 of FIGS. 1 and 3 may enable the use of the logging tool 402 through a full length (depth) of the wellbore 102 up to the cylindrical body 112 of the bridge plug assembly 106 even following water shut-off operations.

Figure 5:
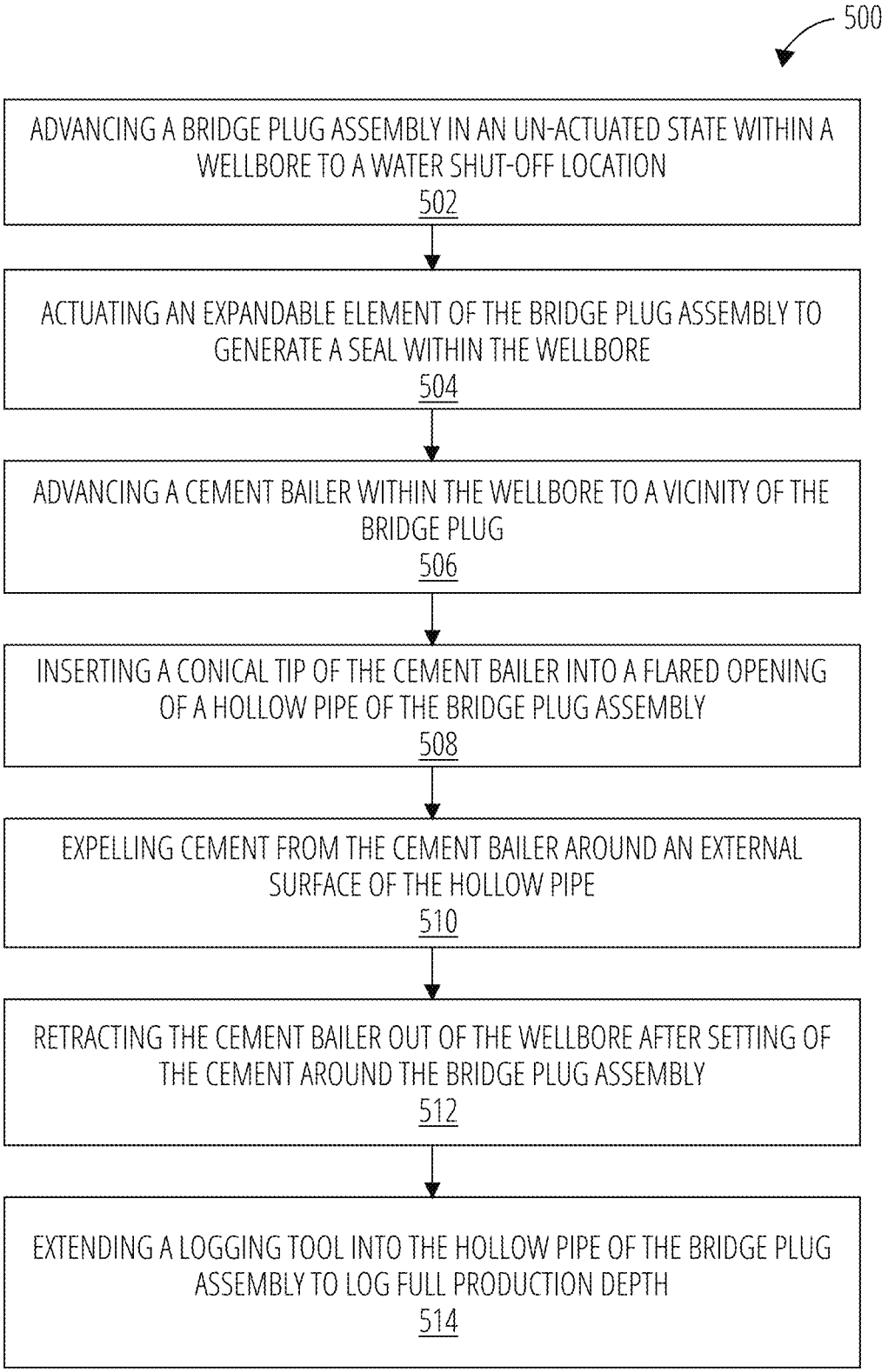
FIG. 5 is a flowchart illustrating an example method for performing a water shut-off operation in a wellbore, according to one or more embodiments consistent with the present disclosure.

In view of the structural and functional features described above, example methods will be better appreciated with reference to FIG. 5. While, for purposes of simplicity of explanation, the example methods of FIG. 5 are shown and described as executing serially, it is to be understood and appreciated that the present examples are not limited by the illustrated order, as some actions could in other examples occur in different orders, multiple times and/or concurrently from that shown and described herein. Moreover, it is not necessary that all described actions be performed to implement the methods, and conversely, some actions may be performed that are omitted from the description.

FIG. 5 is flowchart illustrating an example method 500 for performing water shut-off operations and subsequent logging operations in wellbores, according to one or more embodiments consistent with the present disclosure. The method 500 can be implemented by the system 100, as shown in FIGS. 1-4. Thus, reference can be made to the example of FIGS. 1-4 in the example method 500 of FIG. 5. The method 500 can begin at 502 with advancing a bridge plug assembly (e.g., the bridge plug assembly 106) in an un-actuated state within a wellbore (e.g., the wellbore 102)

via a conveyance, such as a wireline, to a water shut-off location. The water shut-off location may be chosen to divide the wellbore 102 into an upper portion (e.g., the upper portion 108*a*) to be used in further hydrocarbon production and a lower portion (e.g., the lower portion 108*b*) to be isolated due to water production. In some embodiments, the bridge plug assembly may include a hollow pipe (e.g., the hollow pipe 114) extending from a cylindrical body (e.g., the cylindrical body 112) to provide access up to the cylindrical body. The bridge plug assembly may further include a flared opening (e.g., the flared opening 120) at an upper end (e.g., the upper end 116*a*) of the cylindrical body that is in fluid communication with the hollow pipe. The flared opening may provide a wider access point for the hollow pipe and may aid in guiding any fluids or tools towards the hollow pipe.

The method 500 may continue at 504 with actuating one or more expandable elements (e.g., the expandable elements 110) of the bridge plug assembly to generate a seal within the wellbore. The bridge plug assembly may include a plurality of expandable elements that may be extendable to abut an inner circumferential surface of the wellbore and generate an interference fit therein. The bridge plug assembly may provide a signal through the conveyance, such as a wireline to actuate the expandable elements and thereby setting the bridge plug at the water shut-off location. Following setting of the bridge plug and the expandable elements within the wellbore, the method 500 may continue at 506 with advancing a cement bailer (e.g., the cement bailer 122) within the wellbore to a vicinity of the bridge plug. The cement bailer may include an elongate body (e.g., the elongate body 124) that terminates in a conical tip (e.g., the conical tip 128) at a lower end (e.g., the lower end 130) thereof. The conical tip may be sized to be received within the flared opening of the bridge plug assembly as the cement bailer is advanced through the wellbore.

The method 500 may further include inserting the conical tip of the cement bailer into the flared opening of the bridge plug assembly to generate a seal within the flared opening at 508. As discussed above, the conical tip may be sized to be received within the flared opening, such that a conical surface of the conical tip may generate an interference fit with the interior of the flared opening. In a further embodiment, however, inserting the conical tip into the flared opening may further include engaging a magnet (e.g., the magnet 132) of the conical tip onto the flared opening of the bridge plug assembly. In these embodiments, the magnet may provide an additional force to maintain a seal between the cement bailer and the bridge plug assembly, while further aiding in locating the conical tip in place within the flared opening. In some embodiments, the magnet of the conical tip may be inlaid into and circumscribing the conical surface of the conical tip to provide a flush surface on the conical tip while maintaining the magnetic attraction.

The method 500 may continue at 510 with expelling cement (e.g., the cement 202) from the cement bailer around the external surface of the flared opening and the bridge plug assembly. The cement may be expelled through one or more lateral apertures (e.g., the lateral apertures 134) defined in an outer surface of the cement bailer to enable the cement to flow on an outside of the cement bailer and bridge plug assembly. In some embodiments, expelling the cement at 510 may further include actuating a piston (e.g., the piston 206) within the cement bailer to push the cement vertically upwards and out of the lateral apertures. In these embodiments, a wireline (e.g., the wireline 212) may be electrically coupled to the piston and/or the cement bailer to actuate the piston and begin flowing of the cement. The cement may be expelled at 510 until the cylindrical body and top-most expandable elements are surrounded by the cement. The piston allows the amount of cement expelled to be precisely controlled in real time, e.g., the movement of the piston may be interrupted once a sufficient amount of cement has been expelled. The advancement of the piston may be interrupted as needed to retain any remaining cement inside the cement bailer. Once the desired amount of cement is expelled, the cement may be allowed to set, thus cementing the bridge plug assembly in place.

Following cementing the bridge plug assembly in place, the method 500 may continue at 512 with retracting the cement bailer out of the wellbore. Once the cement has set around the bridge plug assembly, the conical tip and flared opening may be decoupled, thus exposing the flared opening to the wellbore flowpath (e.g., the wellbore flowpath 104) to enable fluids or tooling into the cemented bridge plug assembly. The method 500 may then continue at 514 with running a logging tool (e.g., the logging tool 402) downhole to and into the bridge plug assembly. The logging tool may be a production and saturation logging tool operable to gather fluid flow data within the wellbore. As such, the bridge plug assembly and hollow pipe may enable the logging tool to extend through an entire length (depth) of the wellbore up to the cylindrical body of the bridge plug assembly even following a water shut-off operation The logging tool may then perform any desired logging operations within the wellbore throughout the upper portion and into the cemented portion of the upper portion while preventing water penetration across the bridge plug assembly.

Embodiments disclosed herein include:

A. A system for performing water shut-off and logging operations in wellbores, the system including a bridge plug assembly for isolating a lower portion of a wellbore from an upper portion of the wellbore. The bridge plug assembly includes a cylindrical body, one or more expandable elements mounted to the cylindrical body and operable to generate a pressure seal within the wellbore, a hollow pipe extending vertically from the cylindrical body, and a flared opening at an upper end of the hollow pipe. The bridge plug assembly further includes a cement bailer for cementing the bridge plug in place within the wellbore, the cement bailer including a conical tip at a lower end of the cement bailer sized to generate a seal within the flared opening of the hollow pipe of the bridge plug assembly, and one or more lateral apertures defined in an outer surface of the cement bailer and operable to expel cement from an interior of the cement bailer.

B. A method of performing water shut-off and logging operations in wellbores includes advancing a bridge plug assembly in an un-actuated state within a wellbore to a water shut-off location, the bridge plug assembly including a hollow pipe extending from a cylindrical body and a flared opening at an upper end of the hollow pipe, actuating one or more expandable elements of the bridge plug assembly to generate a seal within the wellbore, and advancing a cement bailer within the wellbore to a vicinity of the bridge plug assembly, the cement bailer including a conical tip at a lower end. The method further includes inserting the conical tip of the cement bailer into the flared opening of the hollow pipe of the bridge plug assembly to generate a seal within the flared opening, expelling cement from the cement bailer around an external surface of the hollow pipe of the bridge plug assembly, and retracting the cement bailer out of the wellbore after setting of the cement around the bridge plug assembly.

C. A cement bailer includes an elongate body defining an outer circumferential surface, one or more lateral apertures defined through the outer circumferential surface of the elongate body, a piston mounted within a lower end of the elongate body and operable to push cement towards the lateral apertures, and a conical tip at the lower end of the elongate body and extending vertically downwards.

Each of embodiments A through C may have one or more of the following additional elements in any combination: Element 1: wherein the conical tip of the cement bailer further includes a magnet operable to engage the flared opening of the hollow pipe of the bridge plug assembly. Element 2: wherein the magnet is inlaid into and circumscribing a conical surface of the conical tip. Element 3: wherein the cement bailer further comprises a piston mounted within the lower end of the cement bailer and actuatable to translate vertically to push cement towards the lateral apertures. Element 4: further comprising a cable electrically coupled to the piston for actuation. Element 5: wherein the hollow pipe of the bridge plug assembly is sized to receive a logging tool therein. Element 6: wherein the logging tool extends through the hollow pipe o and up to the cylindrical body of the bridge plug assembly. Element 7: further comprising: running a logging tool downhole to the bridge plug assembly; and extending the logging tool into the hollow pipe of the bridge plug assembly to perform logging operations within the bridge plug assembly. Element 8: further comprising advancing the logging tool through the hollow pipe past at least a portion of the cement around the external surface of the hollow pipe and up to the cylindrical body of the bridge plug assembly to perform logging operations within a cemented portion of the wellbore. Element 9: wherein inserting the conical tip of the cement bailer into the flared opening of the hollow pipe further includes latching a magnet of the conical tip onto the flared opening of the hollow pipe.

Element 10: wherein the magnet of the conical tip is inlaid into and circumscribing a conical surface of the conical tip. Element 11: further comprising: actuating a piston of the cement bailer via a cable electrically coupled to the piston. Element 12: wherein actuating the piston includes translating the piston vertically upwards to push cement upwards within the cement bailer. Element 13: wherein expelling cement from the cement bailer includes pushing the cement vertically towards one or more lateral apertures defined in an outer surface of the cement bailer. Element 14: further comprising a magnet inlaid into and circumscribing a conical surface of the conical tip. Element 15: wherein the piston is positioned to translate vertically upwards to push the cement vertically upwards towards the lateral apertures. Element 16: wherein movement of the piston is interruptible to enable real-time control of a quantity of cement pushed out of the lateral apertures. Element 17: further comprising closure members included within each lateral aperture to control a flow of the cement out of the cement bailer.

By way of non-limiting example, exemplary combinations applicable to A through C include: Element 1 with Element 1; Element 3 with Element 4; Element 5 with Element 6; Element 7 with Element 8; Element 9 with Element 10; Element 11 with Element 12; Element 12 with Element 13; and Element 15 with Element 16.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation used herein are merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A system for performing water shut-off and logging operations in wellbores, the system comprising:

a bridge plug assembly operable to isolate a lower portion of a wellbore from an upper portion of the wellbore, the bridge plug assembly including:

a cylindrical body;

one or more expandable elements mounted to the cylindrical body and actuatable to generate a pressure seal within the wellbore and thereby separate the lower and upper portions;

a hollow pipe extending vertically from the cylindrical body; and a flared opening defined at an upper end of the hollow pipe; and a cement bailer operable to cement the bridge plug in place within the wellbore, the cement bailer including:

a conical tip at a lower end and sized to be received within and generate a seal against the flared opening; and one or more lateral apertures defined in an outer surface of the cement bailer and operable to laterally expel cement from an interior of the cement bailer around an external surface of the cement bailer and into the wellbore.

2. The system of claim 1, wherein the conical tip includes a magnet operable to engage the flared opening of the hollow pipe of the bridge plug assembly.

3. The system of claim 2, wherein the magnet is inlaid into and circumscribing a conical outer surface of the conical tip.

4. The system of claim 1, wherein the cement bailer further includes a piston mounted within the lower end of the cement bailer and actuatable to translate within the cement bailer and thereby push cement housed within the cement bailer towards the one or more lateral apertures.

5. The system of claim 4, further comprising a cable electrically coupled to the piston to provide electrical power for actuation of the piston.

6. The system of claim 1, wherein the hollow pipe is sized to receive a logging tool therein.

7. The system of claim 6, wherein the logging tool is extendable through the hollow pipe and up to the cylindrical body of the bridge plug assembly.

8. A method of performing water shut-off and logging operations in wellbores, the method comprising:

advancing a bridge plug assembly in an un-actuated state within a wellbore to a water shut-off location, the bridge plug assembly including a hollow pipe extending from a cylindrical body and a flared opening at an upper end of the hollow pipe;

actuating one or more expandable elements of the bridge plug assembly and thereby generating a seal within the wellbore at the water shut-off location;

advancing a cement bailer into the wellbore and to the bridge plug assembly, the cement bailer including a conical tip at a lower end;

inserting the conical tip into the flared opening and thereby generating a seal within the flared opening;

expelling cement laterally from the cement bailer through one or more lateral apertures defined in an outer surface of the cement bailer and thereby flowing the cement around an external surface of the hollow pipe; and retracting the cement bailer out of the wellbore after the cement sets around the bridge plug assembly.

9. The method of claim 8, further comprising:

running a logging tool downhole to the bridge plug assembly; and extending the logging tool into the hollow pipe of the bridge plug assembly to perform logging operations within the bridge plug assembly.

10. The method of claim 9, further comprising advancing the logging tool through the hollow pipe past at least a portion of the cement around the external surface of the hollow pipe and up to the cylindrical body to perform logging operations within a cemented portion of the wellbore.

11. The method of claim 8, wherein inserting the conical tip into the flared opening further includes latching a magnet of the conical tip onto the flared opening of the hollow pipe.

12. The method of claim 11, wherein the magnet is inlaid into and circumscribing a conical outer surface of the conical tip.

13. The method of claim 8, further comprising actuating a piston of the cement bailer via a cable electrically coupled to the piston.

14. The method of claim 13, wherein actuating the piston includes translating the piston vertically within the cement bailer and thereby pushing the cement upwards within the cement bailer.

15. The method of claim 14, wherein expelling cement from the cement bailer includes forcing the cement through the one or more lateral apertures using the piston.

* * * * *